US005897464A

United States Patent [19]

Mcleod

[11] Patent Number: 5,897,464

[45] Date of Patent: Apr. 27, 1999

[54] METHOD AND APPARATUS FOR ANKLE EXERCISE

[76] Inventor: Max O. Mcleod, P.O. Box 875, Breaux Bridge, La. 70517

[21] Appl. No.: 08/725,063

[22] Filed: Oct. 2, 1996

Related U.S. Application Data

[60] Continuation-in-part of application No. 08/599,852, Feb. 12, 1996, abandoned, which is a division of application No. 08/266,485, Aug. 22, 1994, Pat. No. 5,518,476.

[51] Int. Cl.[6] ..... A63B 23/08

[52] U.S. Cl. ..... 482/79; 482/132; 482/147; 482/908; 601/27; 601/29

[58] Field of Search ..... 482/51, 52, 71, 482/78–80, 110, 112, 131, 132, 139, 146, 147, 148, 907, 908; 601/23, 27, 29, 31–34, 84, 89, 90, 92, 97, 98, 112; 273/449; 472/14, 25, 26, 40; 434/258, 260, 261; D21/191, 193

[56] References Cited

U.S. PATENT DOCUMENTS

| | | | |
|---|---|---|---|
| D. 227,584 | 7/1973 | Perez | 482/146 |
| 478,166 | 7/1892 | Madsen | 601/32 |
| 2,206,902 | 7/1940 | Kost | 482/79 |
| 4,501,421 | 2/1985 | Kane et al. | 482/80 |
| 4,787,630 | 11/1988 | Watson | 482/71 |
| 4,905,994 | 3/1990 | Hartz | 482/146 |
| 5,135,450 | 8/1992 | Smith, IV | 482/80 |
| 5,292,296 | 3/1994 | Davignon | 482/79 |

FOREIGN PATENT DOCUMENTS

| | | | |
|---|---|---|---|
| 2521435 | 8/1983 | France | 482/79 |
| 2654639 | 5/1991 | France | 482/79 |

*Primary Examiner*—Jeanne M. Clark
*Attorney, Agent, or Firm*—Robert Montgomery

[57] ABSTRACT

A method and apparatus for exercising the subtalar complex with controlled triplaner motion. The principal embodiment includes a standing platform and handrail in association with a rotatable foot plate. The foot plate is controllable and adjustable in three planes with fixed settings in all planes, including the oblique. The exerciser provides a method for isolating specific muscle groups involved with foot, ankle and calf extensions or where combinations of muscles are used, such as, with dorsiflexion-eversion or plantarflexion-inversion, while preventing tibial rotation of the foot. A second embodiment provides a more portable exercise apparatus utilizing the concepts employed with the principal embodiment wherein a rocker member is provided, attached to a support member. A foot plate attaches to the support member opposite the rocker and is pivotal in the transverse and frontal planes.

12 Claims, 15 Drawing Sheets

METHOD AND APPARATUS FOR ANKLE EXERCISE

BACKGROUND OF THE INVENTION

This is a continuation-in-part application of divisional application Ser. No. 08/599,852 filed Feb. 12, 1996 now abandoned which is a divisional 08/266,485, filed on Aug. 22, 1994, issued as U.S. Pat. No. 5,518,476.

FIELD OF THE INVENTION

This invention relates generally to leg and ankle exercise apparatus and more particularly, to a controlled therapeutic apparatus involving the biplane exercise of the calf muscles of the lower leg and ankle. This is correlated with the triplane motion of the subtalar joint. Stretching and mobilizing the triplane subtalar joint and biplane ankle joint are possible according to the individuality of each person by controlling the foot through the subtalar joint and by producing functional motion of the foot and ankle under loaded conditions.

GENERAL BACKGROUND

Prior art apparatus used primarily for the therapeutic stretching of the calf muscles of the lower leg are not usually linked with foot control. In order to properly stretch the calf muscles, it is necessary to position the foot in such a way as to increase the stability of the ligaments and joints of the foot while maintaining mobility of the ankle. The subtalar joint of the foot can be moved around one axis while the ankle joint is being moved around a different axis, if desired. It is also necessary for the motion in each plane to be controlled in a manner which provides a means for repetition of the same movements. Such control further prevents over extension of the muscles or ligaments which could cause additional damage to someone who has a physical impairment in that area.

The prior art discloses various means for exercising the ankle and feet. For example, U.S. Pat. No. 4,739,986 to Kucharik et al, describes a spring loaded ball joint apparatus which uses the swivel action of the ball and spring to exercise the ankle.

Seel et al, in U.S. Pat. No. 4,653,748, describes an ankle platform that sits on a hemisphere with the platform moved through various axes limited only by contact by the platform with the floor.

Dewees U.S. Pat. No. 4,635,932, describes a flexible foot plate for exercising the ankle through various planes of movement for the purpose of proprioceptive rehabilitation.

Troxel, in U.S. Pat. No. 4,605,220, describes an apparatus for exercising the muscles involved in dorsiflexion, plantarflexion, inversion, and eversion while preventing tibial rotation with some controlled limitations.

However, movement is limited to the four basic directions and in the longitudinal and transverse axis only. There is no control of the ankle and subtalar joint motion, and there is no provision for triplane rotation. Smith, in U.S. Pat. No. 4,951,938, discloses a semicircular exercise shoe in which the foot plate has heel and toe portions fixed at different angles and provides only dorsiflexion and plantartlexion exercise.

Kucharik and Troxel are mainly strengthening devices using spring and hydraulic resistance. However, Kucharik uses no control over the biplane movement, and Troxel provides control in only the longitudinal and transverse axis. Seel and Dewees do not provide for guided, controlled movement with respect to the subtalar joint. The Smith device does not provide biplane motion.

The above described apparatus fail to disclose a method for controlling the movement of muscles involved in dorsiflexion and plantarflexion in combination with inversion an eversion while preventing tibial rotation. Muscles affecting the triplane combinations of movements in the transverse, sagittal and frontal planes are specific and in unison. Injury to them constitutes a significant impairment to the foot and ankle function.

Only Seel's patent teaches the loading off the ankle, such as when standing, during the exercise routine. However, Seel makes no provision for controlling repetitive routines nor for the need to locate and position the subtalar joint based on each individual's need. Ankle exercise devices which are capable of rotating the ankle on an involuntary base such as that disclosed by Kost in U.S. Pat. No. 2,206,902 are slow, complicated and fail to properly load the ankle joint as is the case with other ankle exercise apparatus which require the user to be seated as disclosed in U.S. Pat. Nos. 4,501,421 and 478,166. Another type of ankle exercise apparatus are those which are not therapeutic in nature such as that used by a physical therapist or the like but used by individuals to strengthening the ankle and/or muscles. Such devices are disclosed by U.S. Pat. Nos. 5,135,450, 4,905,994 and French Patent 2,654,639. Although the U.S. Pat. No. 5,135,450 and the 2,654,639 patents do provide a rocking means they have very definite disadvantages. For example the invention disclosed by the French Patent requires both a left and right apparatus and has only one rocker located outboard each foot while utilizing a peg inboard of the stop as a pivotal means, restricting pivotal rotation and oscillations by a single heel stop. This arrangement makes rocking movement very jerky and erratic and could result in injury if not performed with great care. The U.S. Pat. No. 5,135,450 patent remedies the rocker problem but fails to provide arch support, thereby strengthening leg muscles but placing excessive strain on the ankle joint itself This patent further relies on a an elongated stop apparatus which is pivotal and allowed to move between fore and aft oscillations of the rocker thus creating a more cumbersome, expensive and complicated apparatus.

The prior art does not teach the need for ankle exercise apparatus attached to elliptical rockers having a foot plate which may be rotated perpendicular to the rockers thereby allowing eversion and inversion to be combined with dorsiflexion and plantarflexion.

It is, therefore an object of the present invention to improve ankle exercise technology in a manner which addresses the need for a controlled therapeutic regimen which links the motions of the foot and ankle with regard to the subtalar joint complex with extension of the calf muscle groups.

It is also an object of the present invention to provide a subtalar joint and muscle exercise apparatus which is repeatable and controllable in all three planes.

A further object of the present invention is the provision of an ankle exerciser that is versatile and useful to both the healthy and physically impaired individual. Still a further object of the present invention is the provision of an ankle exerciser whereby each adjustment setting for each set of repetitions can be recorded.

A further object of the present invention is to provide the user with a means for safely standing on the apparatus with one foot while exercising the foot, ankle and leg while providing normal loading of the subtalar joint and the lower extremity thus, providing normal, functional motion of the subtalar joint in the triplane motion and the ankle in the normal, Biplane motion.

SUMMARY OF THE INVENTION

Recent orthopedic and physical therapy studies have shown that the human foot and ankle operate as a result of the foot being fixed to the ground and reacted upon by ground forces. As a result, the subtalar joint of the foot functions according to its axis which may vary considerably from person to person. The difference in the axis of the subtalar joint complex and the different shapes of the foot produce feet which function in very different manners, according to position of the subtalar joint. The motion of the foot as measured by the angle of the foot relative to the lower leg is dependent not only on the motion at the ankle joint but also motion at the subtalar joint complex. Motion of the ankle has traditionally been thought to be represented and measured clinically by the motion of the foot relative to the ankle when measuring motions in the sagittal plan of the body.

More recent studies, however, are now showing that a sagittal, effective motion of the foot influences a portion of what previously was considered ankle joint motion. This relative degree of motion involving dorsiflexion and plantarflexion in the sagittal plane is a part of the triplane motion of the subtalar joint. This triplane motion of the subtalar joint is fixed and occurs in three planes simultaneously. The planes in which motion occurs are: (i) adduction; inversion and plantarflexion (ii) abduction; eversion and dorsiflexion. Different degrees of dorsiflexion components can be present in different feet according to the shape of the foot and the axis of the subtalar joint components.

The recent studies describe the foot as a very complicated; functional device which has developed over a very long period of time to allow man to ambulate with a bipedal gait. The functional demand for such a gait requires the foot to hit the ground in a supple manner in order to absorb the shock and adapt to the ground while converting to a rigid lever for push-off This function occurs involuntarily because of the axis of the joints and tension of the ligaments. Therefore, for a human to ambulate with a normal gait, there must be correlation of the subtalar and ankle joints as a result of the foot being fixed to the ground by ground reaction forces.

When one begins to treat the individual patient in light of these findings, whereby the foot is fixed to the ground by ground reaction forces, and whereas such forces vary as a result of the shape of the foot and the axis of function of the subtalar joint and the ankle joint in concert; it is readily seen that in order to properly exercise the ankle and calf muscle, one needs to control the subtalar joint motion and its position in concert with the ankle's motion and position. It is further evident that the functional exercise should be performed under strict controls with the foot fixed in order to duplicate the normal ambulatory activity.

Therefore, in order to rehabilitate dysfunction of the ankles and feet, it is necessary to address the fact that motion of the foot may vary according to the ankle or the subtalar joint which produces certain foot types and the specific problems one is rehabilitating. When the subtalar joint is moved into supinated position, the foot becomes more rigid. When the subtalar joint is moved into the pronated position, the toot is more supple. There are always individual variations. As discussed above, the motion of the subtalar joint also controls to some degree the amount of dorsiflexion of the foot relative to the leg. If the foot is in the supple position, then forces will not be directed toward the muscles which cross the tibiotalar joint, (i.e. ankle joint) in order to stretch the structures which cross the ankle joint such as the gastrosoleus muscle and posterior capsule of the ankle, the foot must be in the rigid position so the forces can be exerted upon the ankle joint and not dissipated within the subtalar joint.

It should also be noted that there are three basic foot types: (i) loose flat feet which tend to over-pronate, (ii) normal feet, and (iii) rigid, high arched feet that are in the supinated position. When stretching the flat foot type, the subtalar joint can be placed in the supinated position because the foot will be more stable. The forces will be applied to the ligaments and structures which cross the ankle joint (i.e. the gastrosoleus group and the posterior capsule). Rigid, high arched feet need to be stretched in a more pronated position, as a result, one needs to stretch the subtalar joint structures as well as the structures which cross the ankle. The foot should then be positioned more in the abducted position in the transverse plane. Therefore, the basic idea for the present invention emerges based on the premise that the foot moves in three planes of motion simultaneously. This movement is called triplane motion and is specifically called pronation and supination.

Some feet tend to move in a pronatory pattern while others tend to move in a more supinatory pattern; therefore, foot and ankle exercise should address all three planes of motion simultaneously.

The present invention allows the subtalar joint of the patient to be fixed in position based on the patient's examination by the doctor or therapist. Thus, the subtalar joint can be placed in position for optimum motion and activity of the individual patient's ankle under controlled conditions which can be recorded as settings are changed or cataloged for each individual's foot. The present apparatus allows the therapist to precisely position the patient's subtalar joint in a position which will provide optimum stretching of a particular muscle or ligament as the result of each controlled motion. For example, if the patient has difficulty with abduction and one needs to increase the abduction of the toot and the patient has a flattened, subtalar joint axis which leads to a more supple foot and increased motion in the transverse plane, then the subtalar joint can be placed in the maximally abducted position. Thus, as the patient's foot rolls over the bar with the foot fixed as if on a floor surface with normal ground reaction forces, there is a controlled, increased, stretching motion of the foot with regard to stretching the foot into adduction. By rotating the foot in the opposite direction the opposite is also true for abduction.

A second important point of this invention is that motion of activity simulates normal function activity as well as abnormal activity which may be experienced during a number of athletics such as ball games, skiing, skating, etc. It is imperative that the foot and ankle be loaded during such exercise routines. Therefore, the present apparatus is active as the patient applies his/her own body weight to the joint and ultimately to the muscles and ligaments during the exercise routine. However, it should be noted that such routines are carefully monitored and the stops adjusted as the muscles become stronger and the ligaments are allowed to stretch further.

BRIEF DESCRIPTION OF THE DRAWINGS

The present invention will be better understood by reference to the following detailed description of the preferred embodiment of the present invention when read in conjunction with the accompanying drawings in which:

FIG. 1(*a*) is a rear elevation view of the preferred embodiment;

FIG. 1(*b*) is a partial plan view taken along sight line (1*b*—1*b*) in FIG. 1(*a*);

FIG. 1(*c*) is a right side elevation view of the preferred embodiment;

DETAILED DESCRIPTION OF THE PREFERRED EMBODIMENT

Figure 1:
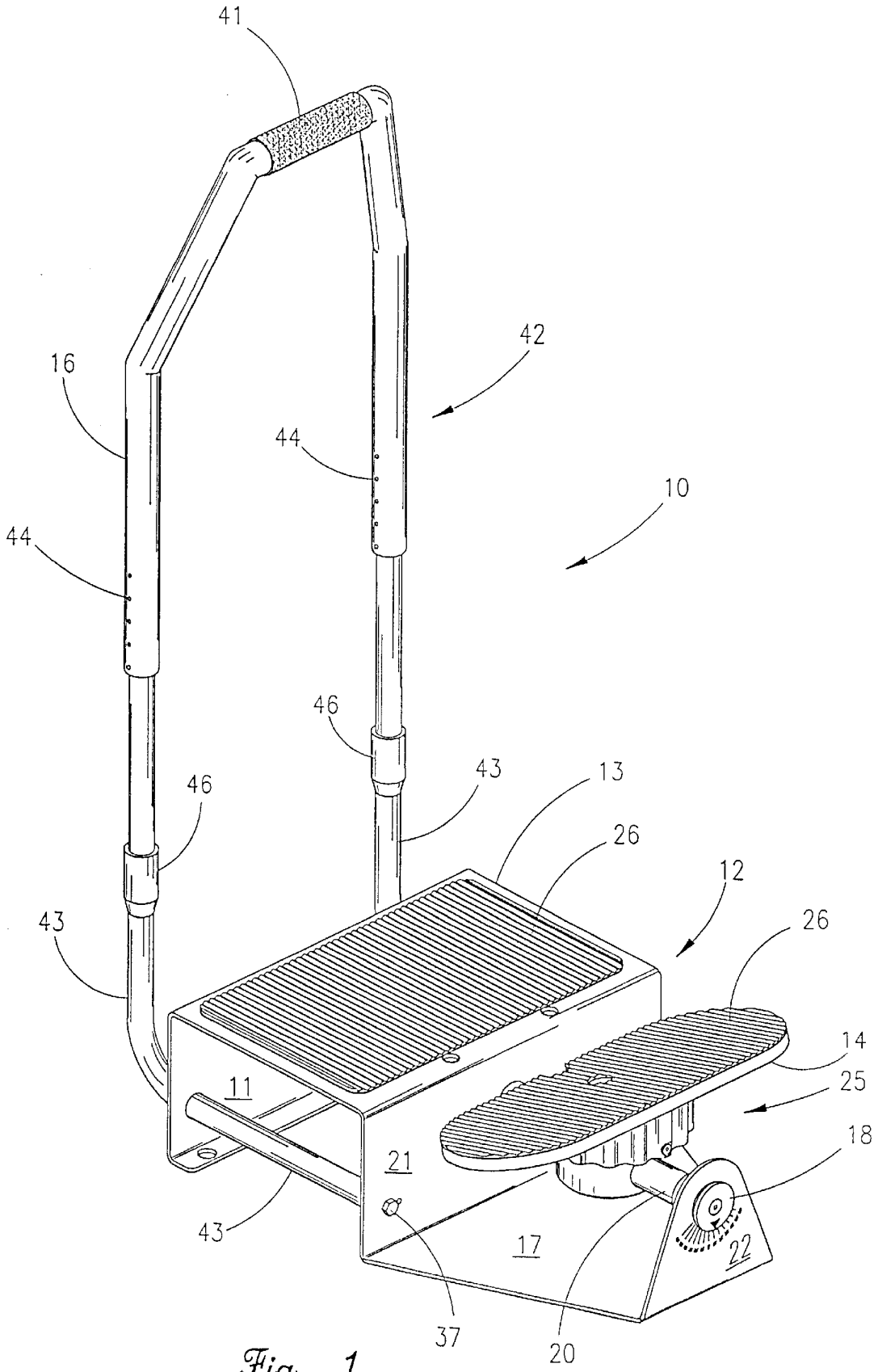
FIG. 1 is an isometric view of the preferred embodiment of the present invention.
Figure 1B:
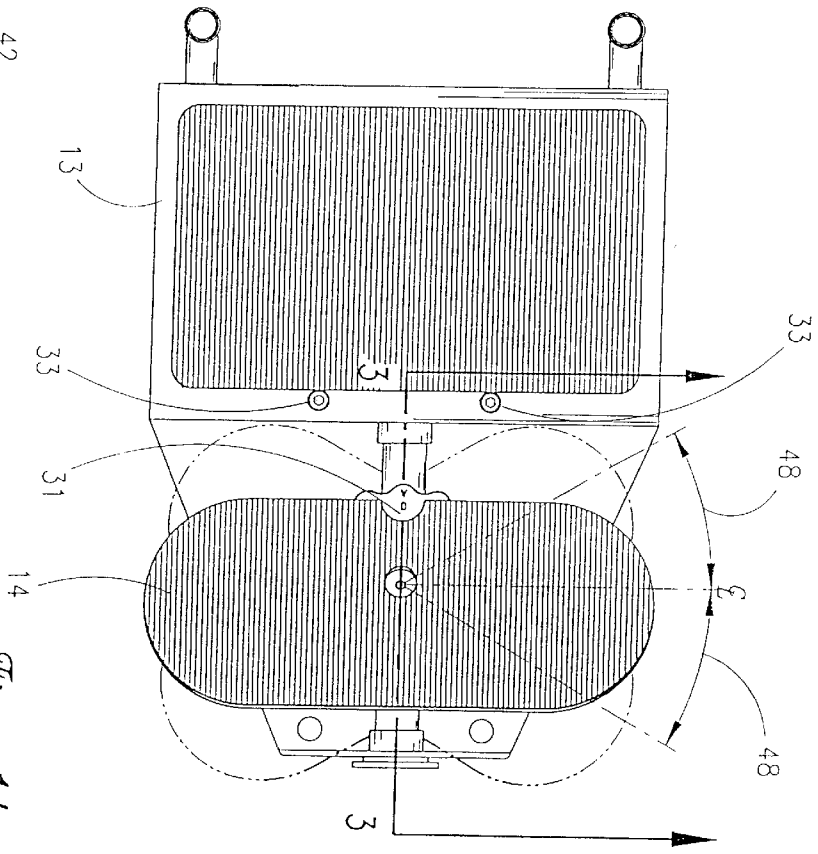

Referring first to FIG. 1, the ankle exercise apparatus 10 essentially comprises: a standing platform 12 for supporting one foot; an adjustable, rotatable foot plate 14 for the opposite foot; and an adjustable handrail 42 for the patients 50 to maintain their balance during the exercise routine as shown in FIGS. 6–12. An inclinometer is comprised of a washer having an arrow inscribed thereon and an orientation hole therein to mate with an orientation pin 18*b* in the rocker shaft 20, is provided at one end of the rocker shaft 20 and a label 18*c* fixed to the outboard vertical wall 22 below the washer lea, containing indicia with incremental, angulation markings to provide a visual indication of the maximum, pivotal incline 15, as shown in FIG. 1*c* where the rotatable foot plate 14 is at acute angles in the sagittal plane.

The base platform 12 is a formed plate having a single synodal, square wave form, configuration with alternating, exposed and concealed channels. The concealed channel portion of the platform provides an elevated, stationary foot support 13, supported by inner and outer walls 11, 21 with the inverse or exposed channel 17 comprised of common wall 21 and an elevated, outboard, vertical wall 22 providing support for the foot plate 14 and rotating rocker assembly 25. The foot plate 14 is rotatably adjustable to some degree with respect to both the frontal and sagittal planes as seen in FIG. 1*a,b,c,*.

Figure 2:
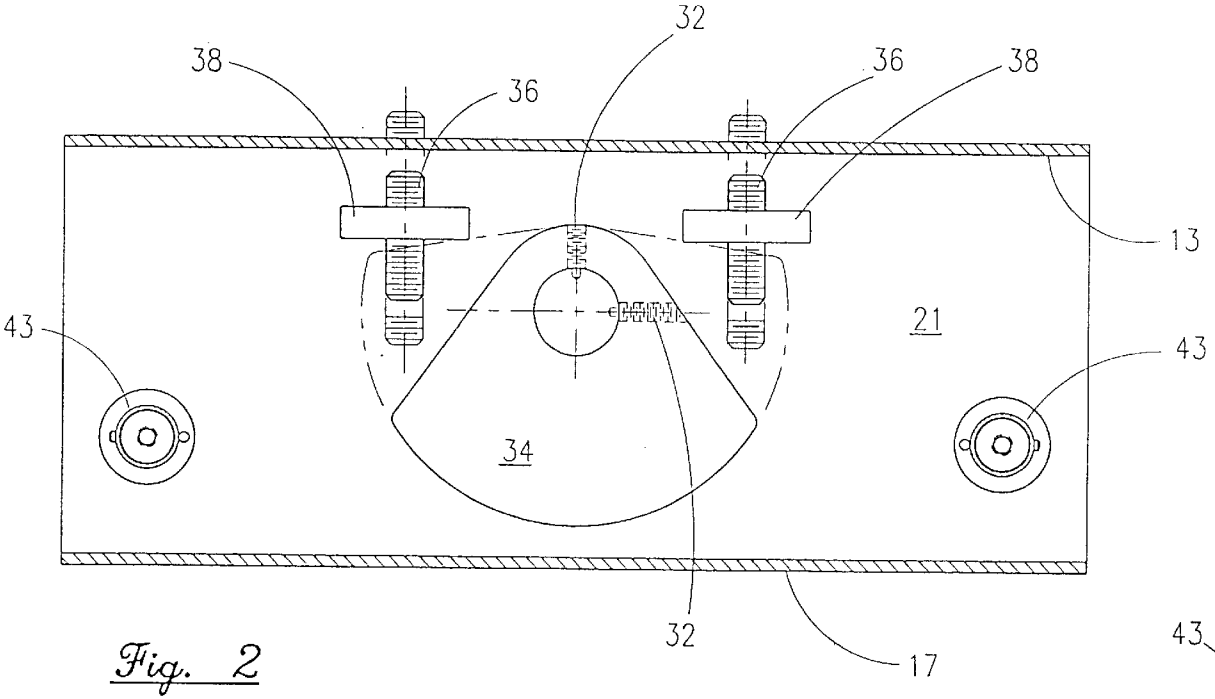
FIG. 2 is a cross section view taken along sight line (2—2)in FIG. 1(*a*)
Figure 3:
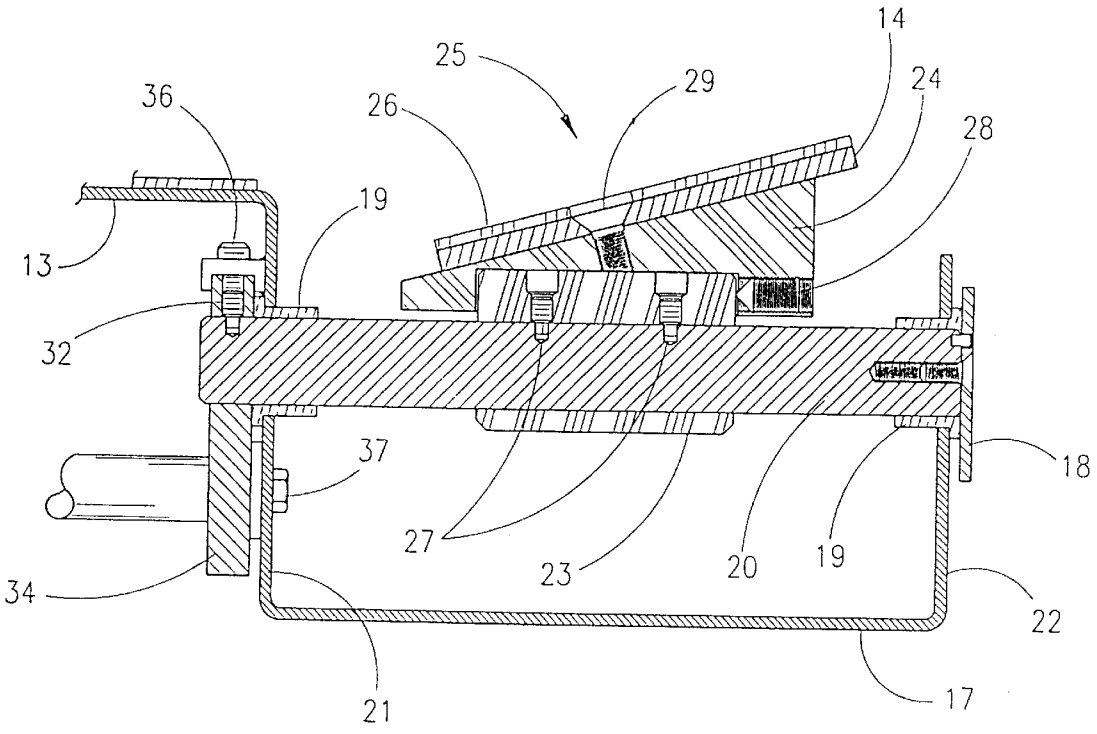
FIG. 3 is a partial cross section view taken along sight line (3—3) in FIG. 1(*b*)
Figure 15:
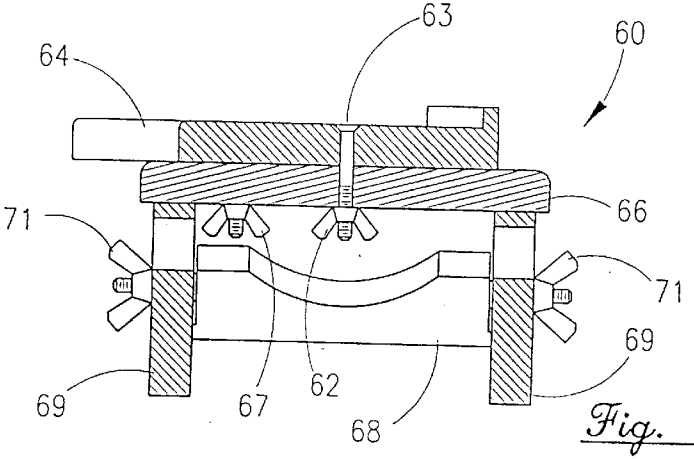
FIG. 15 is a vertical cross section view of the second embodiment taken along the sight line 15—15) in FIG. 14.
Figure 5:
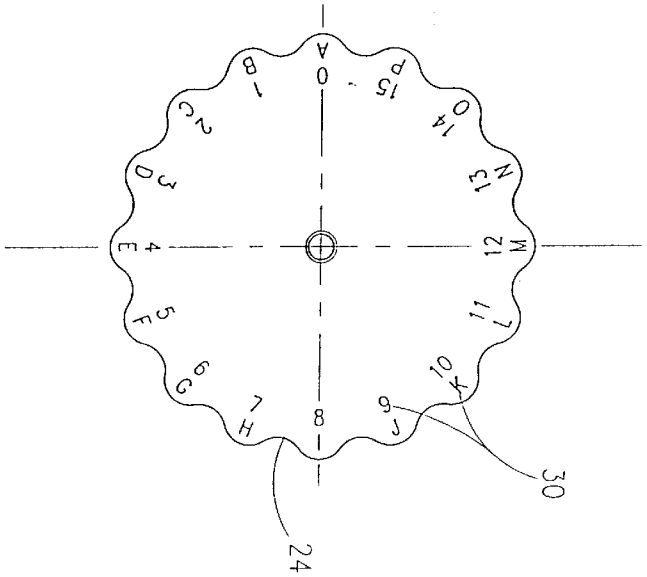
FIG. 5 is a plan or face view of the treadle dial showing alphabetical and numerical calibrations.

As best seen in FIG. 3, the essential components of the rotating assembly 25 are: a rotatable shaft 20 suspended between two bearings 19, one located in the common wall 21 between the stationary foot support 13 and inverse portion 17 and the other in the outboard vertical support 22; a locking hub 23; a dialable rocker support 24; the foot plate 14; and a ribbed, non-skid mat 26. A pair of set-screws 27 are provided in the locking hub 23 to lock the hub 23 to the shaft 20. An adjustment set screw 28 is also provided intersecting the diametrical recess in the dialable rocker support member 24 opposite the truncated end for locking the rocker support member 24 to the shaft locking hub 23. The foot plate 14 is attached to the rocker support member 24 by a single cap screw 29. It should be noted that due to truncation of the, corrugated, cylindrical, dialable, rocker support member 24 the foot plate 14 cap screw 29 is inclined perpendicular to the rocker support member's 24 truncated end face. Although the foot plate 14 cap screw 29 is centrally located in the rocker support member 24, it is offset in the foot plate 14 to allow for viewing the index of engraved calibrations or indicia 30 located on the truncated face of the dialable, rocker support member 24 as seen in FIG. 5. It should also be noted that the rocker support member's 24 cylindrical body is corrugated to facilitate its rotatability. A notch 31 is also provided the foot plate 14 to facilitate the viewing of the calibrations or indicia 30 thereby providing an indication of the pivotal angularity of the foot plate. The rocker shaft 20 extends past its bearing 19 located in the common wall 21 into the channel cavity below the stationary, foot support 13 as seen in FIGS. 2 & 3, where a cam 34 is attached to the rotatable shaft 20 by cam set screws 32.

Figure 18:
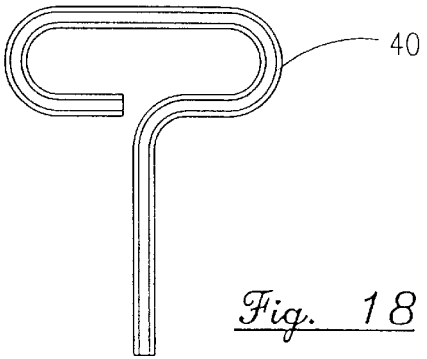
FIG. 18 is an elevation view of a hex key wrench.

Adjustable stop screws 36 threadably operable in a set of tabs 38 which are secured to the inside of the base frame's common wall 21 below the stationary foot support 13, serve as stops, thus limiting the rotation of the rocker shaft 20 in either direction. These adjustable stop screws 36 are adjusted by inserting a tool 40 as seen in FIG. 18 through access holes 33 provided in the stationary, foot support 13. A visual indication of where the stop screws 36 are positioned can be seen and recorded by viewing the inclinometer is attached to the opposite end of the rocker shaft 20 as seen in FIG. 1*c*. The same tool 40 is also used to adjust the set screw 29 in the rotatable foot plate 14 and the dialable, rocker support member 24, adjusting set screw 28.

Figure 1A:
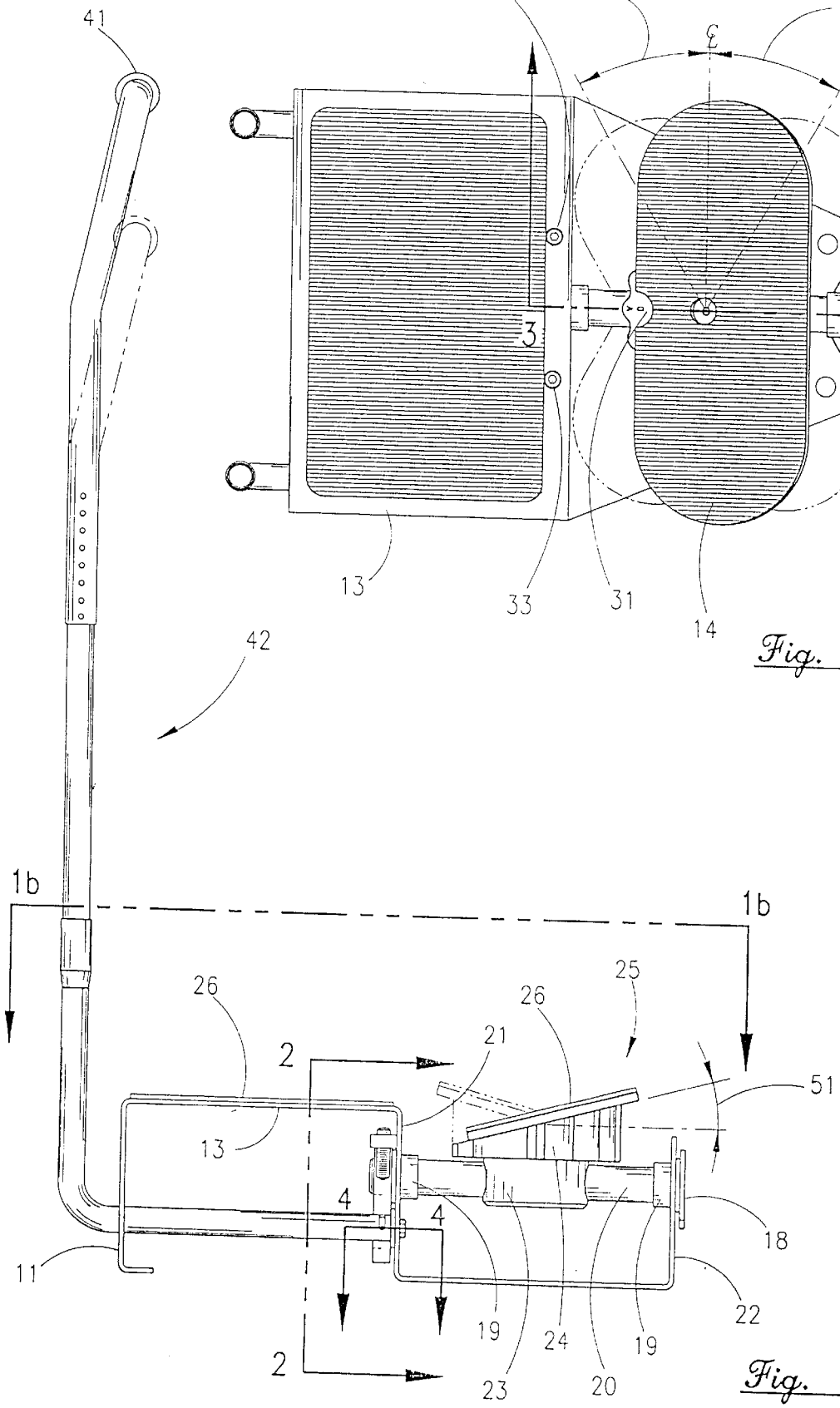
Figure 1C:
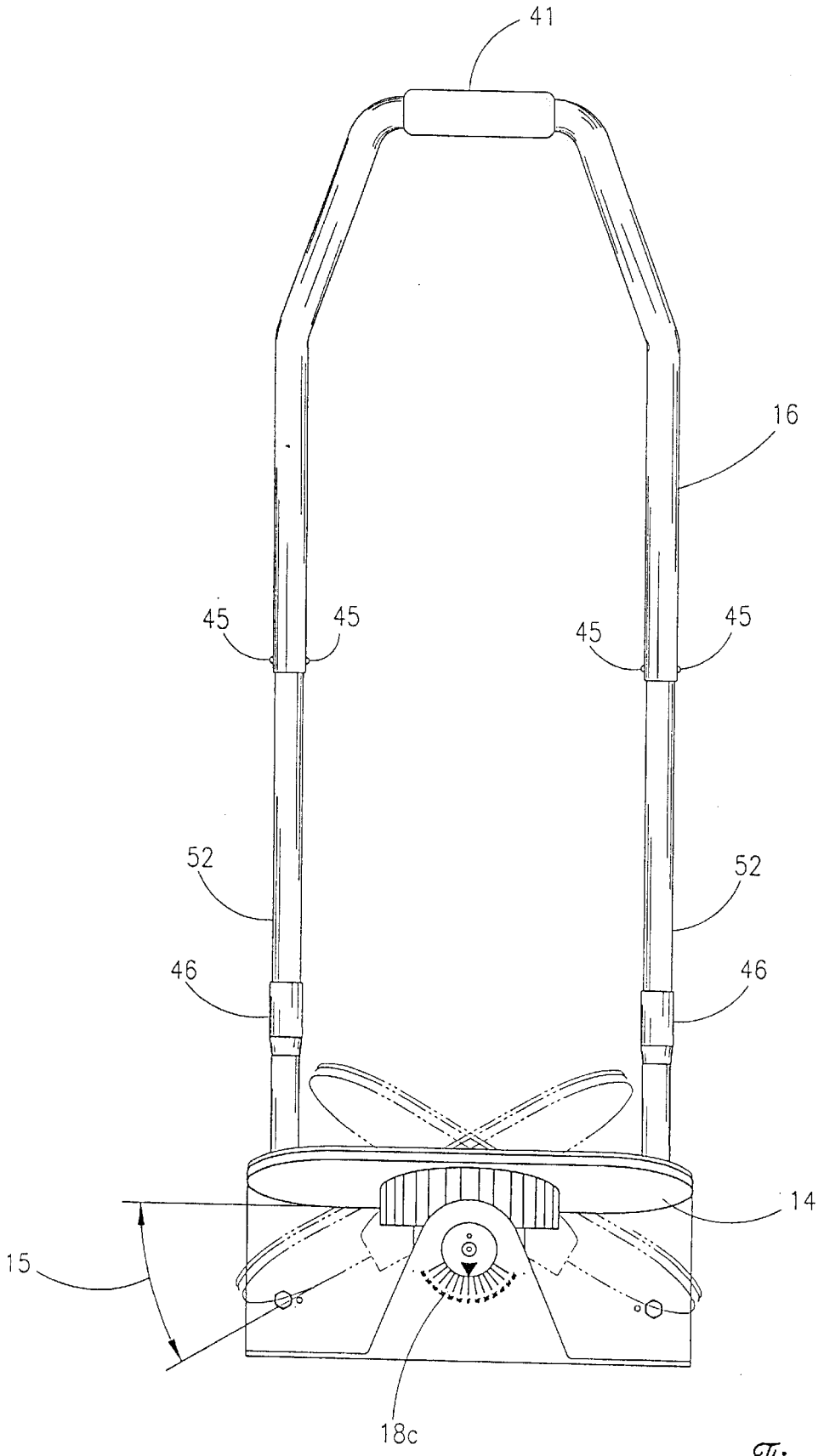
Figure 4:
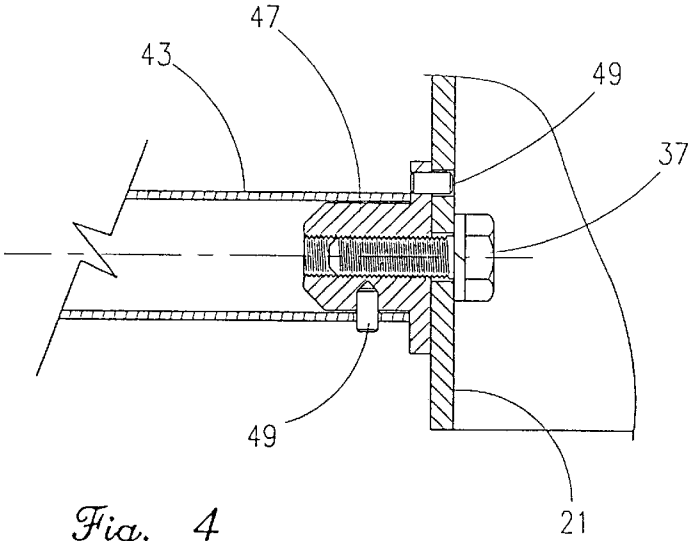
FIG. 4 is a partial cross section view taken along sight line (4—4) in FIG. 1*a;*

A detachable, adjustable handrail assembly 42 is provided as seen in FIGS. 1,1*a*,1*c*. The handrail assembly 42 is constructed in three pieces: (i) a pair of lower curved members 43 having an attachment end which penetrates the outer wall 11 of the stationary foot support 13, and attaches to the inner wall 21 of the support base 12. A hex head screw 37 is threaded into the flange portion of an internal threaded hub 47, secured to the open end of the curved lower handrail member 43 by a hub pin 49 as seen in FIG. 4, secures the lower member 43 to the inner wall 21 while a second hub or orientation pin 49 extending from the flange portion of the threaded hub 47 corresponds with a hole in the support base's inner wall 21, further serving to prevent rotation of the lower curved handrail member 43; (ii) an intermediate tubular members 52 connected to the lower curved members 43 by coupling reducers 46 which provide reduction from the intermediate tubular members 52 and further serves as lower stops, and (iii) the "U-shaped" upper tubular member 16 which telescopes over each of the two intermediate tubular members 52. Springable push buttons 45, as seen in FIG. 1*c,* are provided on each of the intermediate members 52 for mating alignment with a series of handrail holes 44 seen in FIG. 1 in each of the two legs of the upper tubular member 16, for retracting and extending the height of the upper tubular member 16 to the patient's 50 height. A foam pad or rubber cushion hand grip 41 can be used on the handrail's, upper tubular member 16 to provide a better grip. A nonskid material 26 is also provided on the surface of the stationary foot support 13 to help prevent slipping.

Figure 6:
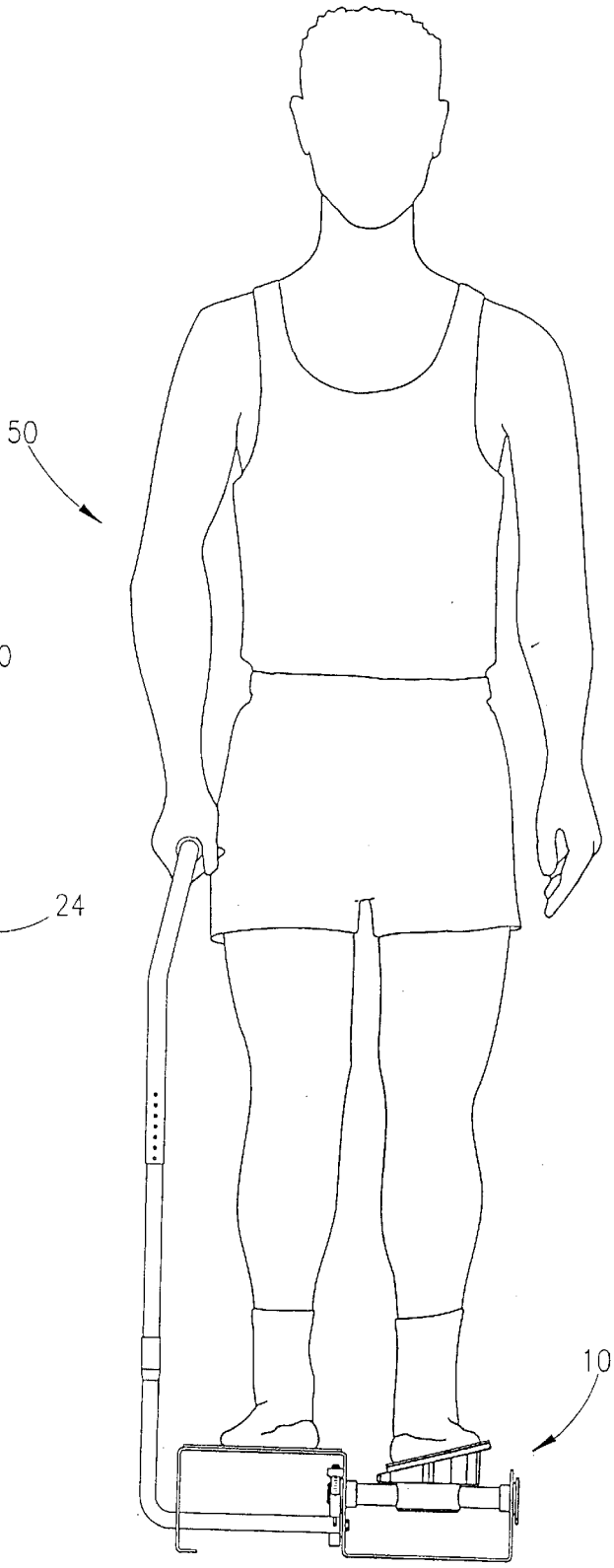
FIG. 6 is a front elevation showing the patient using the invention with the left foot on the treadle assembly in the frontal plane and the foot and ankle illustrating eversion.
Figure 7:
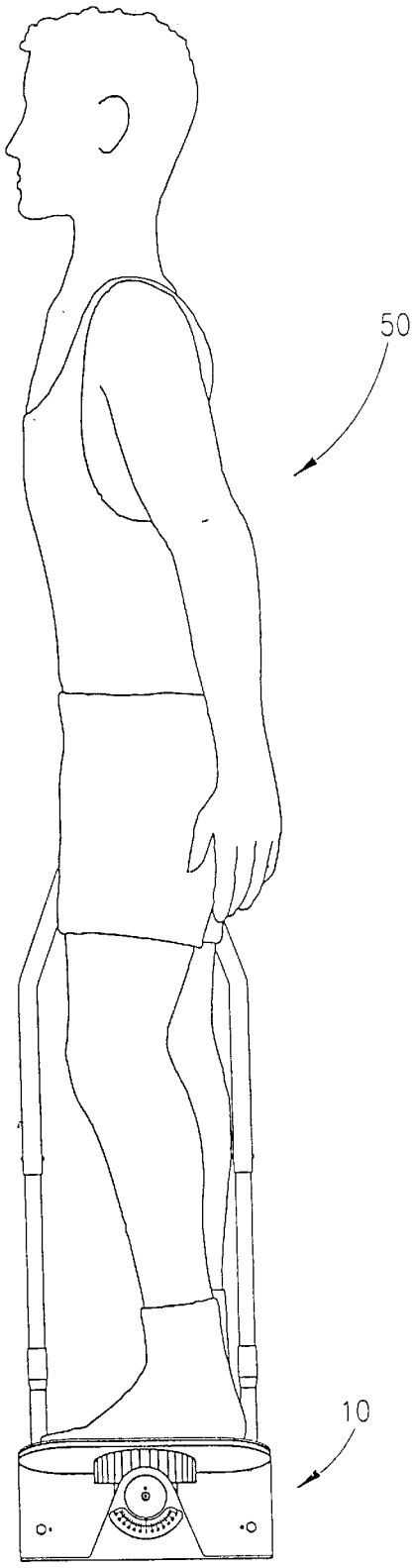
FIG. 7 is a right side elevation showing the patient using the invention with the left foot on the treadle plate in the sagittal plane and the foot and ankle illustrating eversion.
Figure 8:
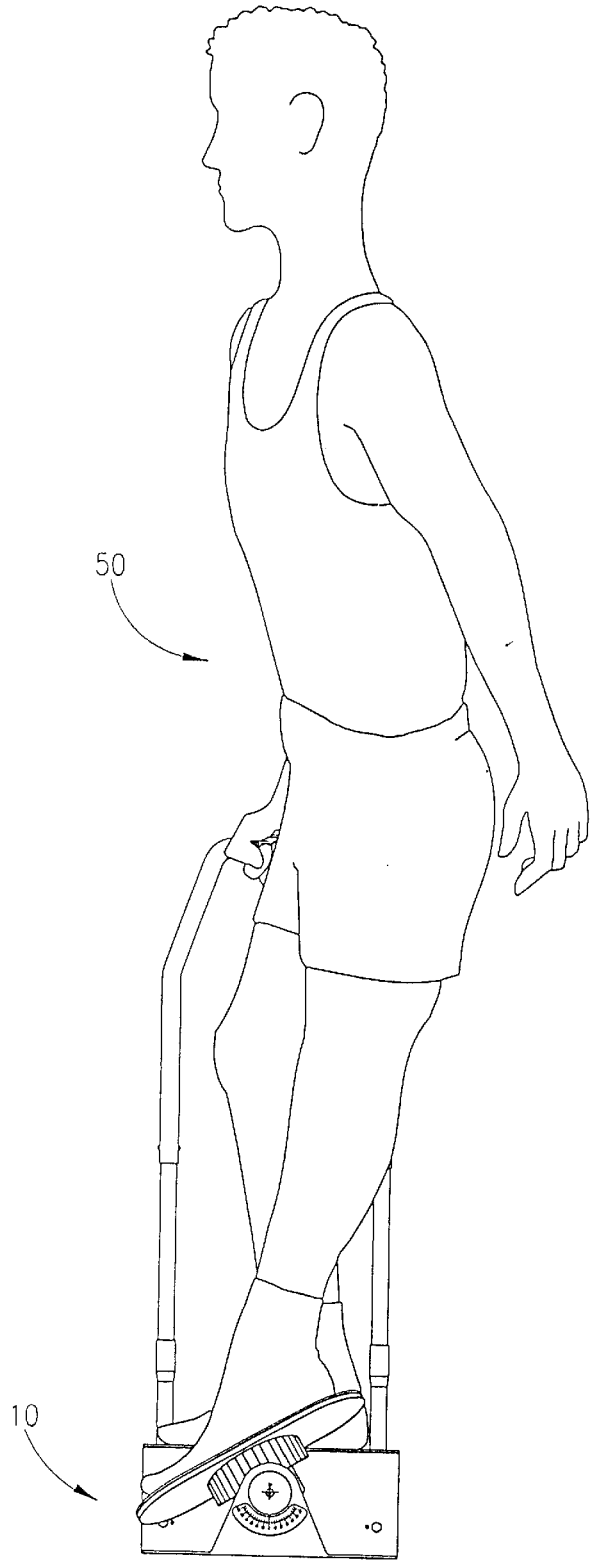
FIG. 8 is a right side elevation showing the patient using the invention with the left foot on the treadle plate and the foot and ankle illustrating plantartlexion combined with eversion.
Figure 9:
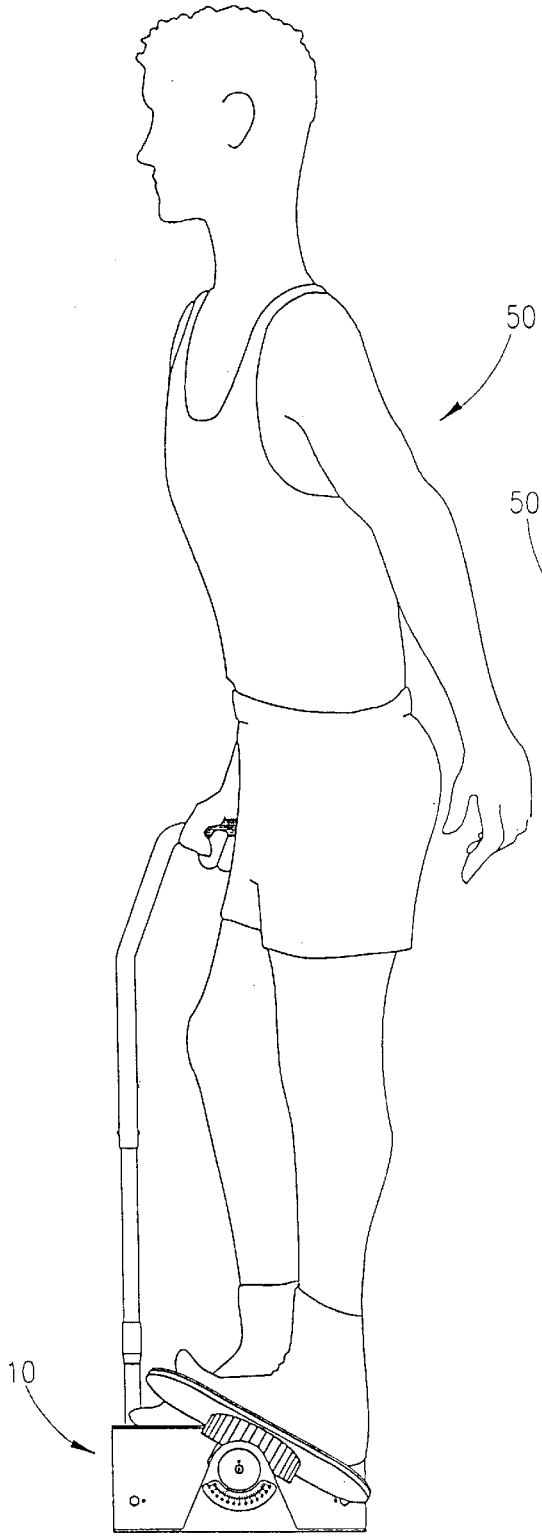
FIG. 9 is a right side elevation showing the patient using the invention with the left foot on the treadle plate and the foot and ankle illustrating dorsiflexion combined with eversion.
Figure 10:
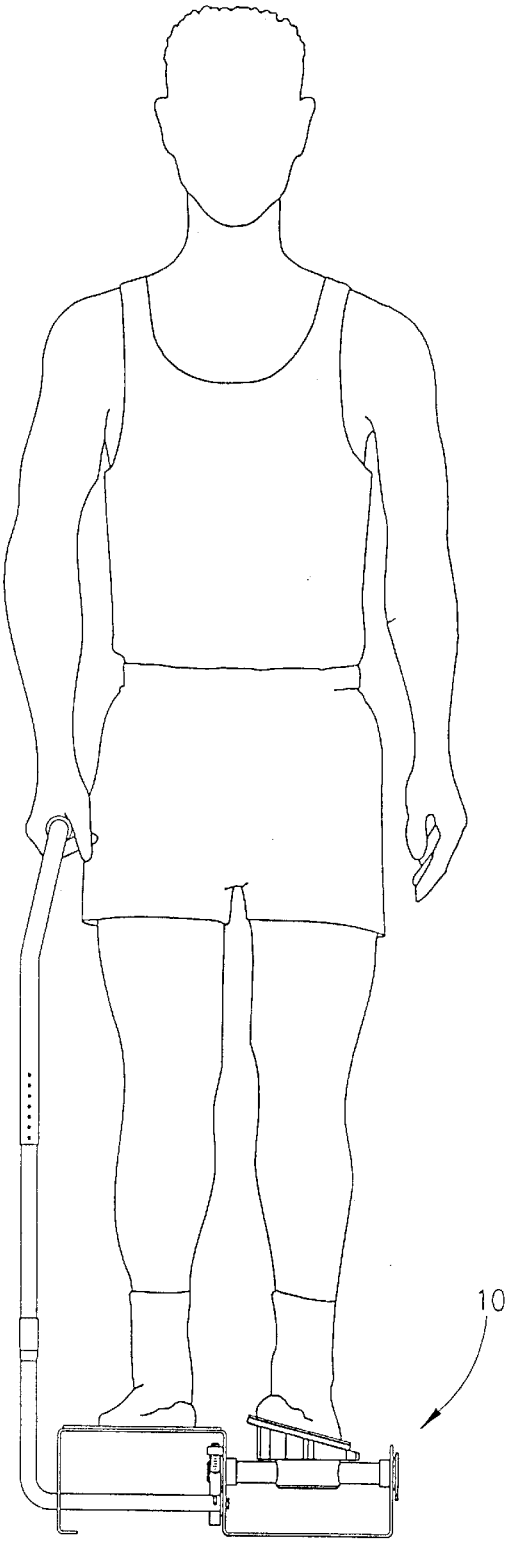
FIG. 10 is a front elevation showing the patient using the invention with the left foot on the treadle plate and the foot and ankle illustrating inversion.
Figure 11:
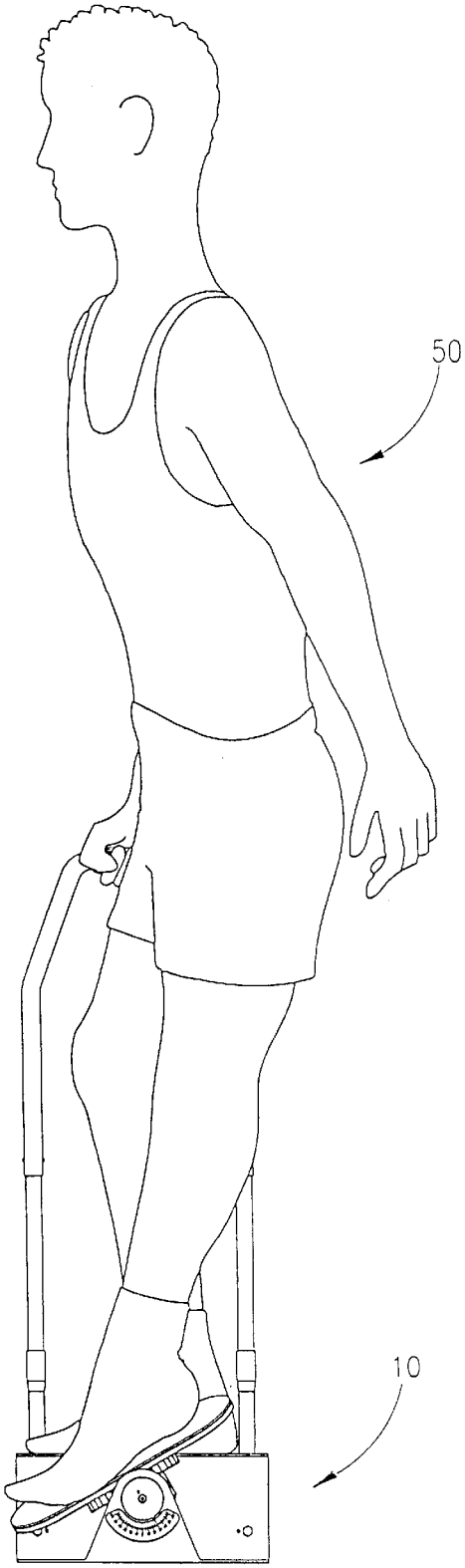
FIG. 11 is a right side elevation showing the patient using the invention with the left foot on the treadle plate and the foot and ankle illustrating plantarflexion combined with inversion.
Figure 12:
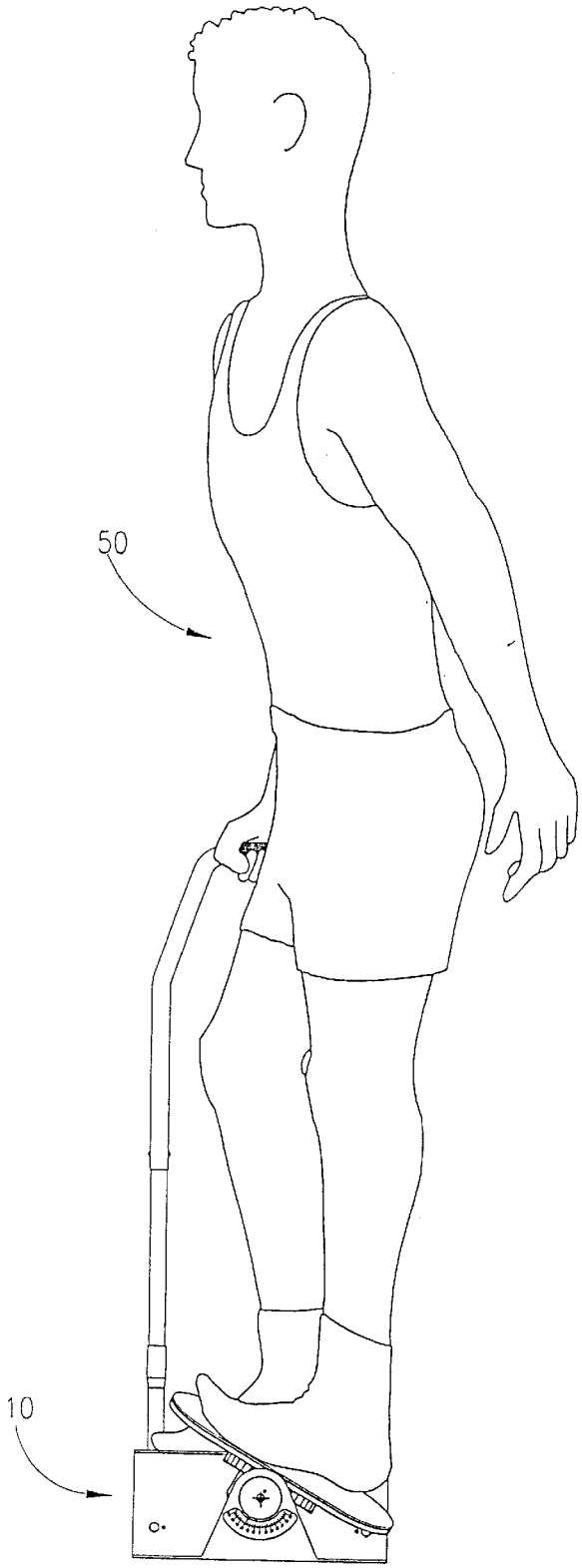
FIG. 12 is a right side elevation showing the patient using the invention with the left foot on the treadle plate and the toot and ankle illustrating dorsiflexion combined with inversion.
Figure 13:
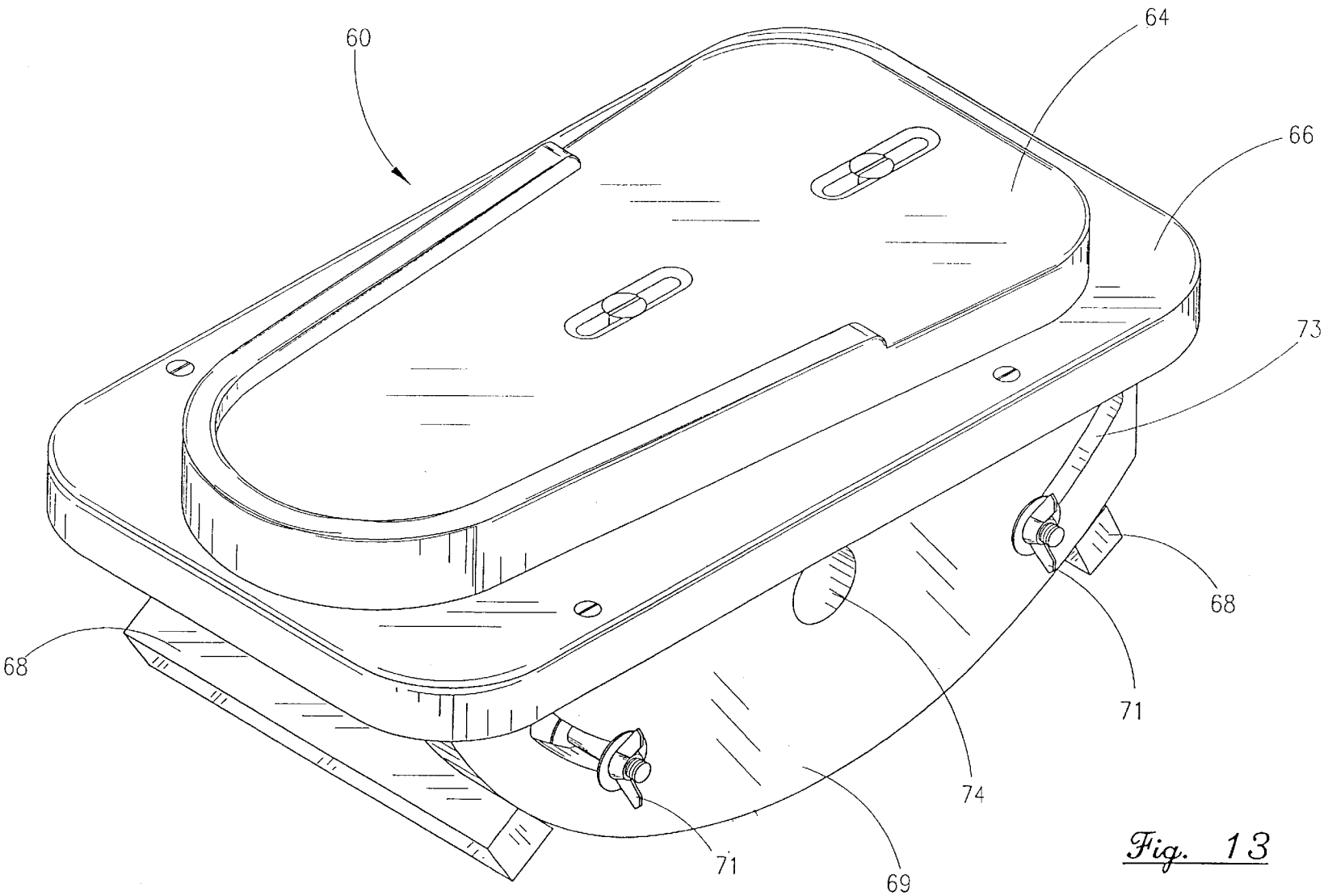
FIG. 13 is an isometric view of a second embodiment of the invention.
Figure 14:
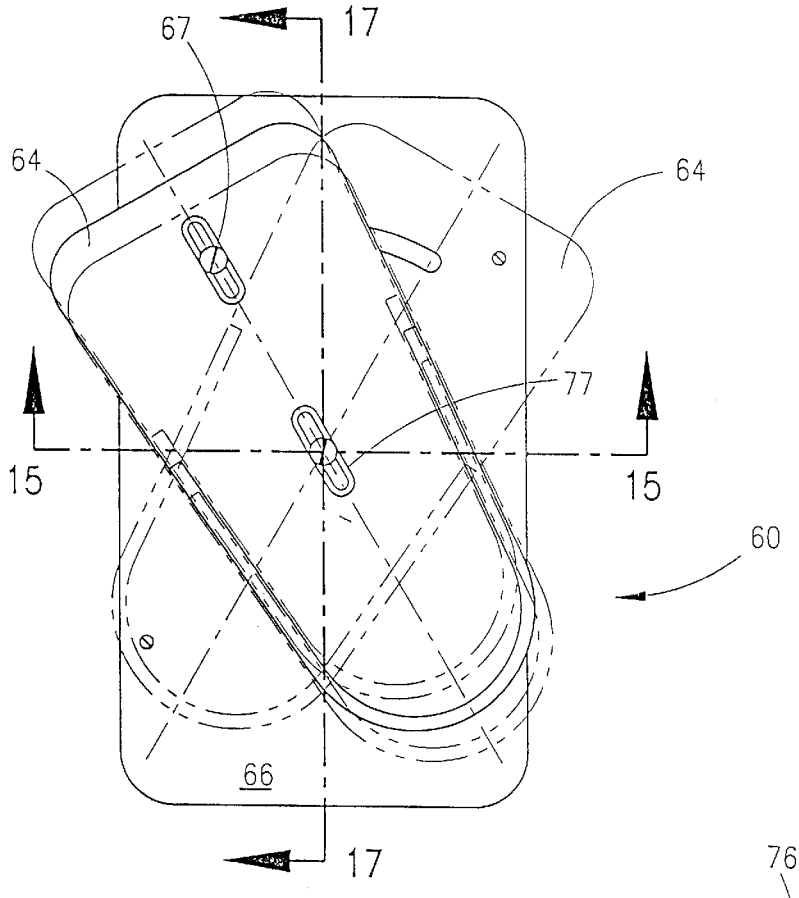
FIG. 14 is a top view of the second embodiment.
Figure 19:
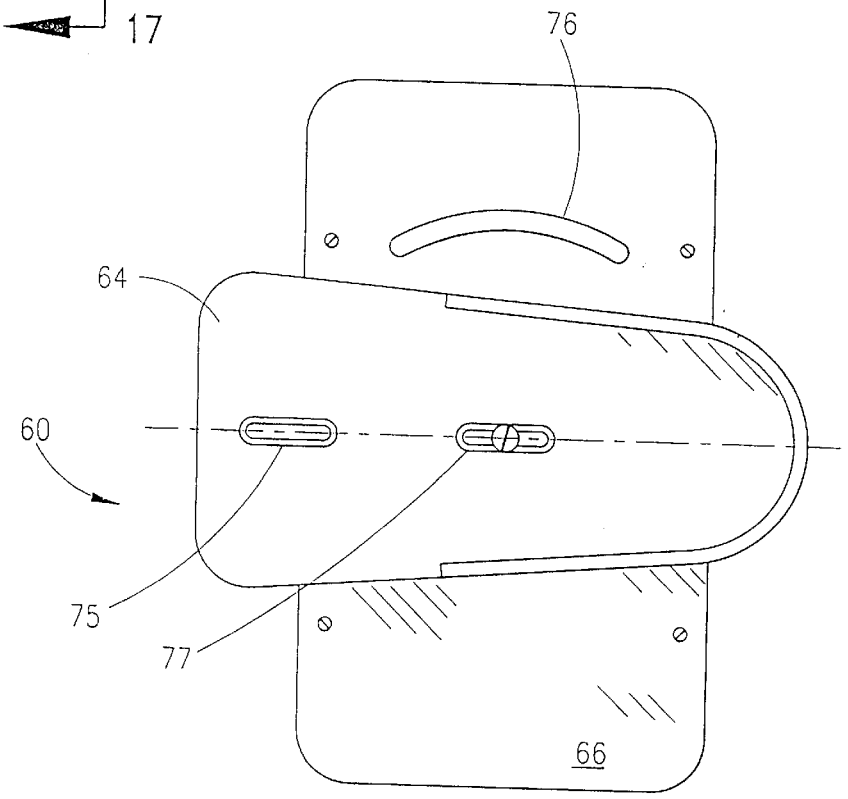
FIG. 19 is a top view of the second embodiment showing the foot plate [pivoted] rotated 90 degrees.
Figure 16:
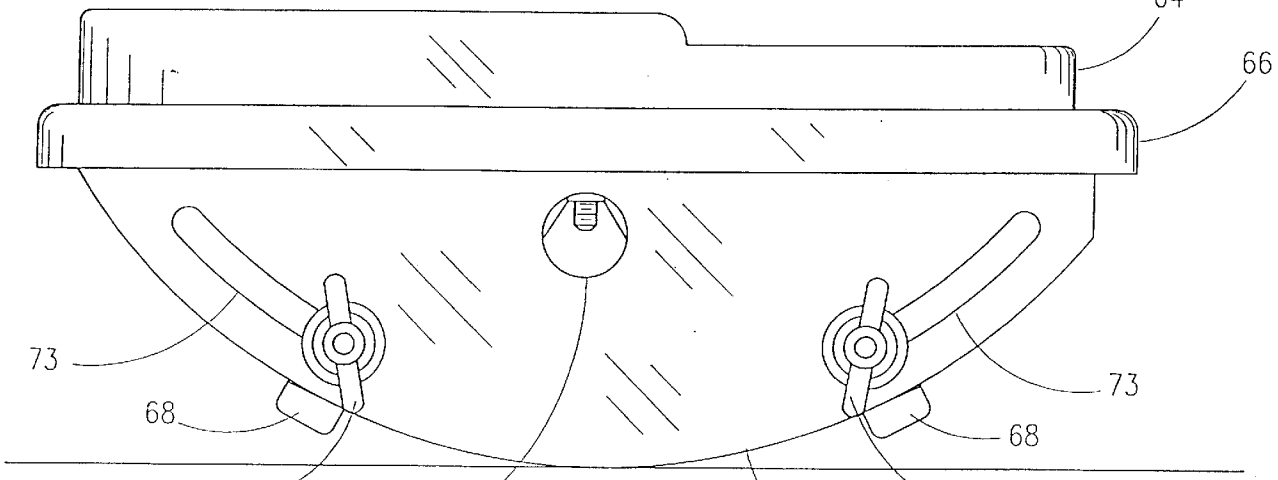
FIG. 16 is a right side elevation view of the second embodiment.
Figure 17:
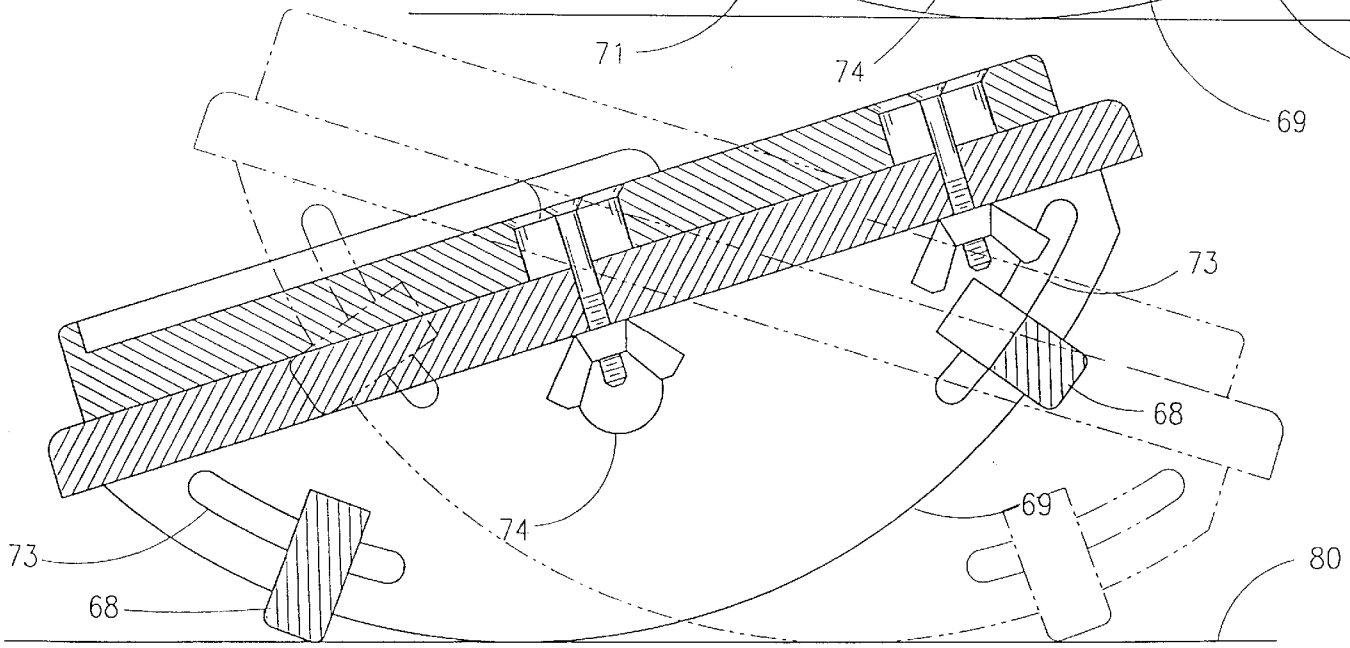
FIG. 17 is a vertical cross section view of the second embodiment taken along sight line (17—17) in FIG. 14 showing the rocker stops in contact with the horizontal surface.
Figure 20:
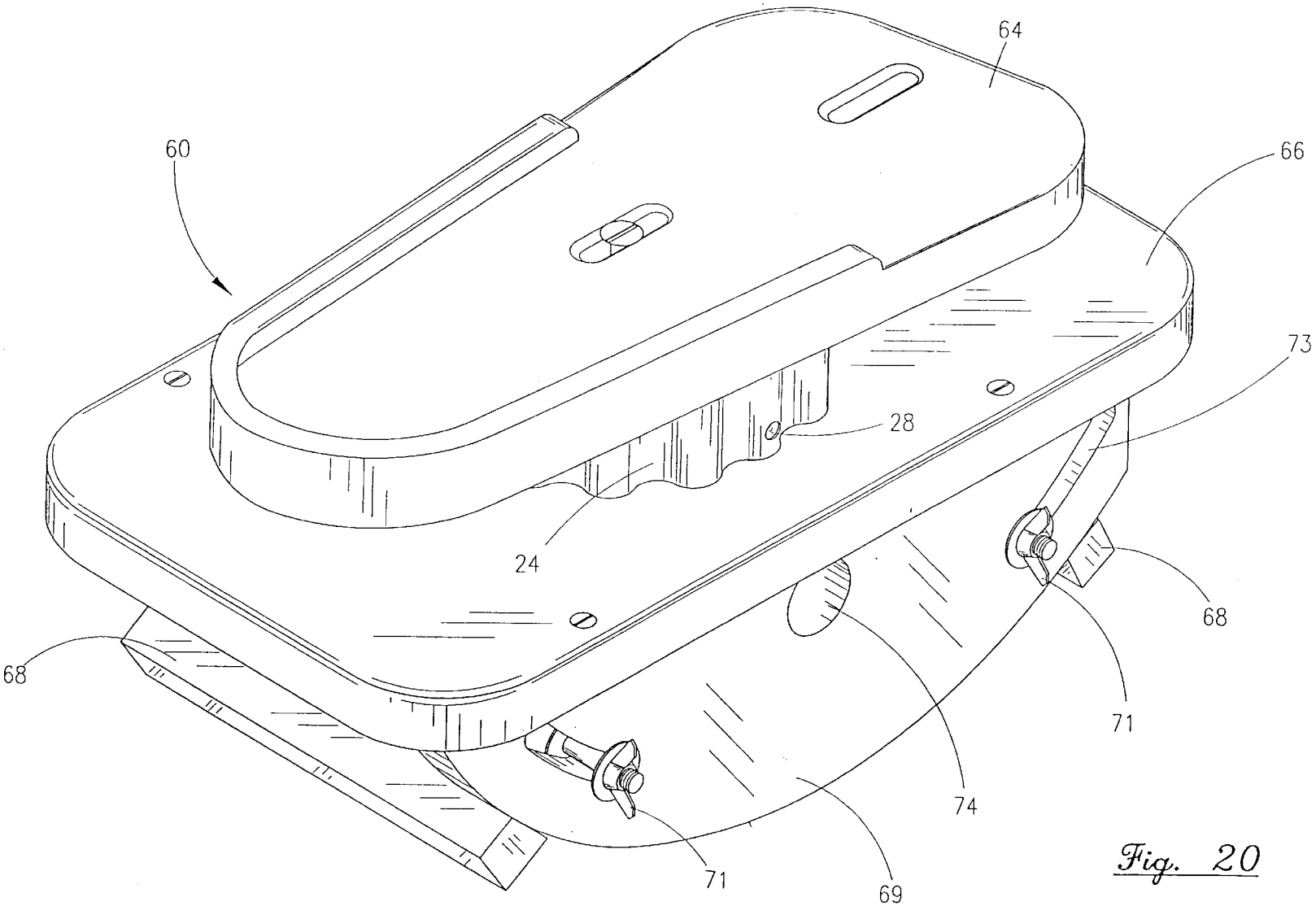
FIG. 20 is an isometric view off a third embodiment with the truncated dialable support member used in the first embodiment, employed between the foot plate and bridge member.
Figure 21:
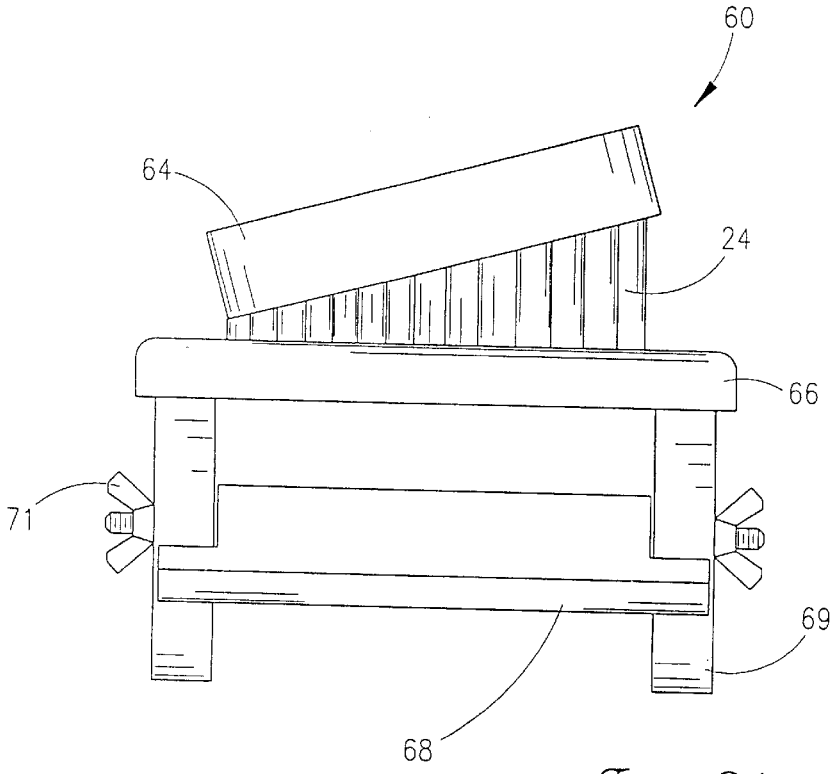
FIG. 21 is an end elevation view of the third embodiment shown in FIG. 20.
Figure 22:
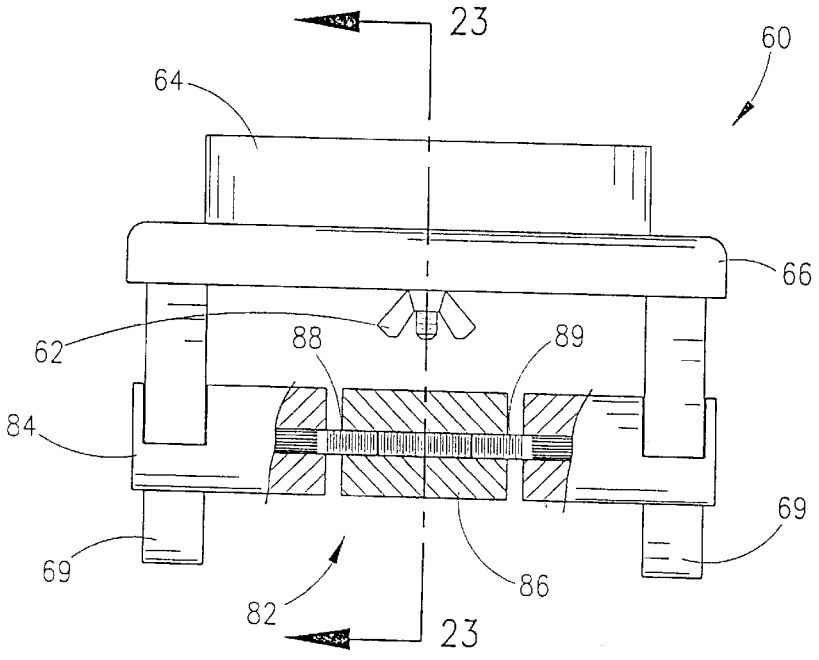
FIG. 22 is an end elevation view of the second embodiment having a novel alternative stop arrangement.
Figure 23:
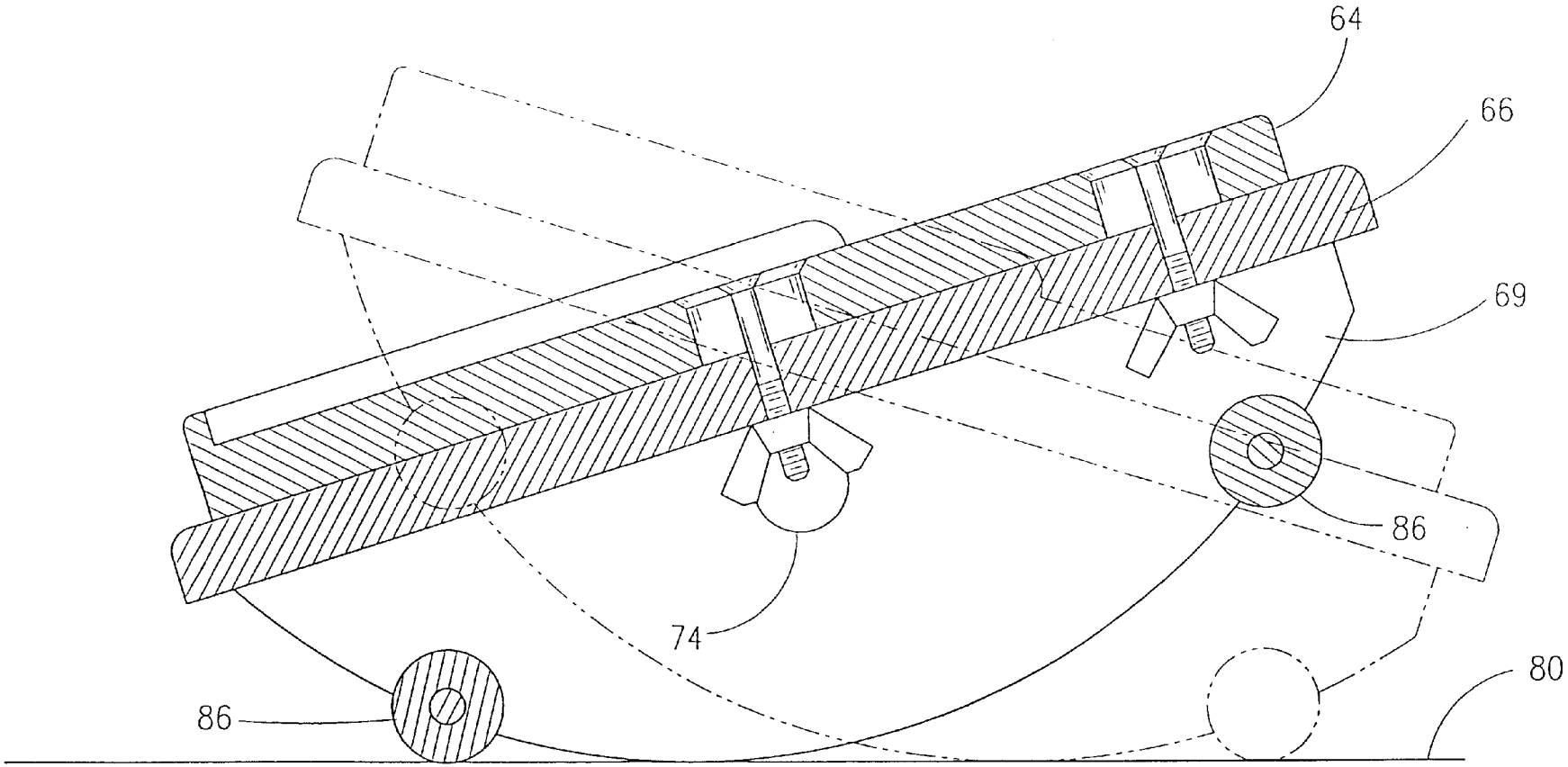
FIG. 23 is a side, cross section view taken along sight line 23—23 in FIG. 22.

One of the most significant features of the present invention is the dialable, rocker support member 24 which is a cylindrical, elongated body typically with a truncated face of up to 30 degrees as seen by angle indication 51 in FIG. 1*a*. However, an intermediate support member with both faces parallel can be used to replace member 24 when no inversion or eversion is required. It should also be noted that a method for securing a foot to the foot plate 14 such as with straps could be used. A dial type, adjustable foot positioner as taught by the prior art may also be adapted to the rotatable foot plate 14 if desired. The primary advantage of this apparatus is its ability to be adjusted to fixed settings in the transverse and oblique axis. The engraved calibrations or indicia 30 on the dialable, rocker support 24, shown in FIG. 5, provide two settings, one numerical and the other alphabetical. As seen by FIGS. 1*a* & 1*b,* the dialable, rocker support 24 can be rotated about the shaft hub 23 and independently from the rotatable foot plate 14. Therefore, the dialable, rocker support 24 can be rotated to any of the alphabetical settings, by adjusting the dial set screw 28 seen in FIG. 3, thus effecting up to approximately 30 degree angles of the rotatable foot plate 14 in the frontal plane relative to the patient's 50 stationary foot as seen in FIGS. 6 & 10. The rotatable foot plate 14 can also be rotated with respect to the numerical indicates 30 by loosing the rotatable foot plate 14 set screw 29 as seen in FIG. 3, thus allowing for transverse plane, angles 48 of approximately 30 degrees either side of center line as shown in FIG. 1*b*. As a result of the truncated face of dialable, rocker support 24, oblique angles 15 of thirty degrees can be achieved in the oblique or sagittal plane as indicated in FIG. 1*c* by angle. Thus, the patient or user 50 can achieve combinations in all three planes, the transverse, sagittal, and frontal, as shown in FIGS. 8,9,11, & 12. Exercise combinations consisting of dorsiflexion combined with inversion and plantartlexion with eversion or dorsiflexion combined with eversion and plantarflexion combined with inversion, can be achieved. These combinations are all controllable by indexing and setting angulation and limit stops. A second embodiment capable of performing the above described exercise, with the exception of not being as precisely controlled, is depicted by FIGS. 13–23. In FIG. 13 a rocker exerciser 60 is shown which operates very similarly to that of the prior art, with the exception being an adjustable foot plate 64 which equates with the rotatable foot plate 14 in the preferred embodiment of the ankle exercise apparatus 10. This embodiment 60 of a rocker exerciser 40 allows the user 60, physician, or therapist to set the angulation deemed as the most appropriate between the two extremes angles shown in FIG. 14. Adjustment is achieved by loosening wing nuts 62, on the center and guide bolts 63,67 best seen in FIG. 15, extending the foot plate 64 forward or backwards via its slots 75, 77 or rotating the adjustable foot plate 64 axially about its center bolt 63, and retightening the nuts 62 on both the center and guide bolts 63,67. It is obvious in view of the first embodiment of the ankle exerciser 10 that a truncated spacer or dial 24 could also be placed between the adjustable foot plate 64 and the bridge member 66, in the manner illustrated in FIG. 20 & 21 thus effecting inversion and eversion of the ankle joint combined with dorsiflexion and plantarflexion simply by providing a means for mounting and securing the adjustable foot plate 64 independently of the support member 66 and the truncated spacer whereby it is also independent and free to turn. As mentioned in the first embodiment of the ankle exerciser apparatus 10, in most cases this provision is not required. However, as seen in FIG. 19, inversion and eversion may also be achieved in combination with dorsiflexion and plantarflexion, heretofore not available in the art for a free standing, foot manipulated, rocker type ankle exerciser. These combinations are all controllable by indexing and setting angulation and limit stops. By simply rotating the foot plate 64, upon releasing wing nuts 62, and removing the guide bolt 67, the foot plate 64 may be rotated to an acute angle of up to 90 degree degrees, with respect to the bridge member 66. A pair of adjustable stops 68 are also provided to set limits of rotation of the rocker members 69, with respect to a horizontal surface 67 as seen in FIGS. 16 & 17. These stops 68 are fitted between the two, semicircular disk shaped, rocker members 69 which are in turn attached to the bottom portion of the bridge member 66. Adjustment of the stops 68 is effected by loosening the wing nuts 71 at either end of the stop 68 and repositioning the stop 68 in its slot 73. An alternative stop arrangement is illustrated in FIGS. 22 & 23 which eliminates the need for slots 73 and wing nuts 71 and allows for infinite adjustment. This type of stop assembly 82 includes a pair of end pieces 84 having slots adapted to the rocker members 69, a rotatable center member 86 having a left and right hand threaded members 88~B9 which extend into and are secured to the end pieces 84. Therefore, when center member 86 is rotated, force is applied to the two end pieces thereby wedging the stop assembly 82 between the rocker members 69 at any position along their periphery.

To use the rocker exerciser 60, the user stands on a horizontal surface or floor 80, and places one foot on the rocker exerciser 60. The user then rotates the apparatus by pressing down on the rocker exerciser 60 in a heel-toe oscillating or rocking manner as seen in FIG. 17, thus rotating the ankle about the diametrical axis of the semicircular disk rockers 69. A shaft could be located through the holes 74 provided in the semi-circular disk rockers 69 thus suspending the rockers 69 slightly above floor or horizontal surface 67. This produces-a change in the axis of rotation thereby emulating the first embodiment of the ankle exerciser apparatus 10.

As a result of the foot adjustment controls as described supra, very specific patient problems can be addressed. Some specific examples of therapeutic methods of treatment utilizing the present invention are as follows:

Example 1; Heel cord stretching for an individual's pronatory flat foot with excessive abduction of the foot. To address this problem it is necessary to loosen the adjusting set screw 29 and rotate the foot plate 14 in the transverse plane to approximate the patient's 50 natural foot position. Loosen the dialable rocker support 24 with set screw 28, have the patient 50 stand on the apparatus 10 with one foot on the stationary foot support 13 and place the affected, pronated foot on the foot plate 14, keeping the patient's 50 hip and knee in a full, frontal plane and parallel to the axial rotation of the rotating assembly 25. This exerted, internal rotation of the foot with respect to the leg will supinate a person's subtalar joint; however, this will often cause the medial side of the foot to elevate from the foot plate 14. Therefore, the dialable rocker support 24 may be adjusted to compensate, thus bringing the medial side of the foot plate 14 up against the medial foot thereby making the foot more stable. With the foot internally rotated or adducted, the subtalar joint is supinated and the foot is inverted, thus locked into position or rigid. The patient 50 can now be allowed to rotate the foot back, in the sagittal plane and stretch the ankle or heel dord, similar to that shown in FIGS. 10 & 12. The therapist can then adjust the cam set screws 32 indictable by the inclinometer 18 thereby allowing only a certain amount of foot plate 14 rotation at a time. Example II; Stiff but normal human foot following a cast removal due to a fractured tibia.

With the foot plate 14 in the neutral or non-rotated position in the transverse plane as shown in FIG. 1*b,* the patient 50 then stands on the apparatus 10 with one foot on the stationary foot support 13 placing the affected foot on the foot plate 14, while keeping the hip and knee in a true, full, frontal plane, parallel to the axial rotation of the rotating assembly 25. If the person's foot has no other problems the rocker support 24 should be rotated so that its highest point is perpendicular to the axial rotation of the rotating assembly 25. This maintains the foot plate 14 in neutral with respect to the frontal plane. The patient 50 can now mobilize the foot in the sagittal plane by rotating the foot plate back, similar to that shown in FIG. 12.

However, if pronation of the foot is a problem, the dialable rocker support 24 can be rotated either in or out approaching the longitudinal axis of the rocker assembly 25, thus moving the individual's ankle in a bi-planer fashion. This causes a combination of movements of plantarflexion-inversion as seen in FIG. 11 and dorsiflexion-eversion as seen in FIG. 12 or plantarfiexion-eversion as seen in FIG. 8 and dorsiflexion-inversion as seen in FIG. 9

Example III Protected movement following an ankle sprain;

With the foot plate 14 in neutral in the frontal, transverse and sagittal planes, adjust the sagittal plane, adjustable, stop screws 36 for the desired angle of plantiflexion and dorsiflexion as indicated by the inclinometer 18. The patient 50 then stands on the apparatus 10 with one foot on the stationary foot support 13 while placing the affected foot on the foot plate 14, keeping the hip and knee in a true, full frontal, plane perpendicular to the axial rotation of the rotating assembly 25. Have the patient 50 start sagittal plane rotation movements within the stop screw 36 settings. By observing the inclinometer 18 the therapist can determine if it is necessary to readjust the limiting, stop screw 36 if the initial setting can not be reached as a result of excessive pain for the patient 50. If more protection from inversion is required, the dialable, rocker support 24 may be adjusted to evert the foot plate 14 to prevent undue strain on the injury and the not yet as strong muscle or ligament while still allowing the exercise of the other normal foot and ankle motions. As the patient progresses with the activities, the angle stops can be readjusted to allow for greater angulation of the foot plate 14 in the sagittal plane. The foot plate 14 can also be adjusted in the frontal and/or transverse plane to allow for bi-planer movements thereby actually stressing the muscle or ligament or groups thereof in a controlled, prescribed manner as the cartilage and ligaments become stronger.

The above examples illustrate how the triplane exerciser can be adjusted to accommodate the three cardinal planes of motion. This apparatus allows a multitude of adjustments which address most of the problems associated with foot and ankle therapy, in a safe and prescribed manner.

What is claimed is:

1. An ankle exercise apparatus comprising:

a) a bridge member;

b) a foot plate, pivotally and longitudinally adjustable relative said bridge member, attached to said bridge member in a manner wherein said foot plate can be rotated transversely pivoting about a central connection point and said footplate is slotted adjacent said connection point to allow positioning longitudinally relative to said bridge member;

c) a pair of semicircular rocker disks, vertically attached in a spaced apart manner to said bridge member, opposite said foot plate; and d) a pair of adjustable stop means attached to said rocker disks for adjustably limiting rotation of said disks in fore and aft rotation relative a support surface, said pair of adjustable stop means being independently adjustable one from the other.

2. An ankle exercise apparatus according to claim 1 wherein said foot plate is further adjustably secured to said bridge member by a guide bolt located adjacent said central connection point, said bridge member being slotted to allow for transverse positioning of said foot plate at said guide bolt.

3. An ankle exercise apparatus according to claim 1 wherein said semi-circular rocker disk are slotted for receiving at least one said adjustable stop means.

4. An ankle exercise apparatus according to claim 1 wherein said foot plate is fitted with a railing surrounding at least a major portion of said foot plate.

5. An ankle exercise apparatus according to claim 1 wherein said foot plate and bridge member is separated by a truncated cylinder independently rotatable, relative to said foot plate and said bridge member.

6. An ankle exercise apparatus according to claim 1 wherein said foot plate, having a heel end and toe end, further comprises an elevated portion surrounding most of said foot plate except for a portion of said toe end, said foot plate being wider at said toe end than said heel end.

7. A method of exercising a human foot and ankle, using a floor rocker type exercise apparatus having ability to control, by limiting, positioning and subsequent movements of said foot and ankle about said ankle's neutral axis in its transverse and sagittal plane while in the loaded condition comprising the steps of:

a) standing adjacent a rocker type ankle exercise apparatus, with one foot on said floor, said rocker type apparatus comprising; semi-circular disk having individually, adjustable, limiting stops for controlling rotation for either plantaflexion or dorsiflexion positioning of a user's foot, a bridge member attached to said semi-circular disk and a foot plate pivotal and transversely adjustable relative said bridge member;

b) placing foot to be exercised on said rocker apparatus, adjusting said foot plate in the transverse plane relative said rocker and rotating said foot in a heel to toe manner, about the diametrical axis of said rocker in said foot's sagittal plane;

c) adjusting said foot plate pivotally to an oblique position, in said foot's transverse plane, as necessary, in a manner wherein said foot and ankle's subtalar joint is in a position which provides optimum stretching of a particular muscle, ligament or group thereof;

d) setting said limiting stops independently to control rotation of said rocker means according to user's muscle limitation in said sagittal plane for optimum motion and activity of an individual's ankle;

e) performing sagittal plane, rotation movements in an oscillating manner within said limiting stop settings; and f) readjusting said foot plate and said limiting stops as necessary to gain full extension of said ankle joint in all three planes.

8. A method of exercising according to claim 7 further including the step of rotating said foot plate 90 degrees to said disk thus allowing said foot and ankle to be placed perpendicular to the axis of rocker rotation.

9. A method of exercising according to claim 7 further including the step of providing a truncated cylinder means located between said bridge member and said foot plate, to allow for oblique, angle positioning of said foot in said frontal plane.

10. A method of exercising according to claim 8 further includes the step of positioning said foot plate longitudinally relative to said bridge member in a manner wherein said foot and ankle's subtalar joint is in a position which provides optimum stretching of a particular muscle, ligament or group thereof.

11. A therapeutic method of exercising a human foot and ankle joint through triplane motion of an individual's subtalar joint comprising the steps of:

a) placing a standing patient's foot upon an exercise apparatus having triplaner rotation capability comprising;

i) a semi-circular rocker means for oscillating rotation about a centroid axis approximate that of a user's ankle joint in contact with a support surface;

ii) a foot plate pivotal and transversely adjustable relative to said rocker means;

iii) a plurality of individually adjustable stop means for adjustably limiting rotation of said rocker means in fore and aft rotation relative to said support surface said stop means being independently adjustable one from the other; and iv) a truncated cylinder means located between said bridge member and said foot plate;

b) adjusting said apparatus to allow extension of said patient's foot when rotated in an oscillating manner in said foot's sagittal plane;

c) maintaining patient's hip and knee perpendicular to said foot's frontal plane while patient rotates said foot, producing foot plantarfiexion and dorsiflexion within limits set by said individually adjustable stops means in said foot's sagittal plane;

d) adjusting said apparatus by rotating said foot plate perpendicular to said rocker means and rotating said rocker means perpendicular to said user's foot to allow extension of patient's foot in said foot's frontal plane thereby producing ankle inversion and eversion;

e) adjusting said foot plate transversely as required to more closely align said centroid axis with said ankle joint; and f) readjusting said exercise apparatus at proscribed intervals until full foot and ankle extension is achieved.

12. A therapeutic method of exercising the human foot and ankle through triplane motion of the subtalar joint according to claim 11 further includes the step of, attaching a truncated cylinder means to said exercise apparatus to allow for oblique angle positioning of said foot in said frontal plane and adjusting said cylinder independently of said foot plate and rocker means to allow oblique rotation of patient's foot in the transverse plane thereby supinating said subtalar joint thus producing foot plantar-flexion-inversion and dorsiflexion-eversion within set limits in said foot's sagittal plane.

* * * * *